United States Patent [19]

Nohrenberg et al.

[11] 4,146,255

[45] Mar. 27, 1979

[54] KNOT TYING DEVICE AND METHOD FOR TYING

[75] Inventors: Warren R. Nohrenberg, Omaha; Richard L. Brown, Bellevue, both of Nebr.

[73] Assignee: Idea Engineering Company, Bellevue, Nebr.

[21] Appl. No.: 918,843

[22] Filed: Jun. 26, 1978

[51] Int. Cl.[2] ..... B65H 69/04

[52] U.S. Cl. ..... 289/1.5; 289/2; 289/5

[58] Field of Search ..... 289/1.5, 2, 5, 11; 28/219

[56] References Cited

U.S. PATENT DOCUMENTS

| | | | |
|---|---|---|---|
| 2,489,488 | 11/1949 | Haack | 289/2 |
| 3,112,132 | 11/1963 | Fauring | 289/5 |
| 3,889,990 | 6/1975 | Messa | 289/5 |
| 4,022,501 | 3/1977 | White | 289/11 |

*Primary Examiner*—Louis Rimrodt

*Attorney, Agent, or Firm*—George R. Nimmer

[57] ABSTRACT

Knotting devices for tying incrementally fed string into overhand knots comprises a pair of sturdy opposed angular bills extending uprightly as stalks from a manipulatable shank and the bills including opposed horns laterally extending from the stalks and at a transverse fixed-spacing. Once the string increment is looped around the horns, its trailward-length is resiliently grasped by a retainer means located between the horns to form a noose. Following severing of the string trailward-length, its lead-end is pulled away from the knotting device and the noose slips off the bill horns foreends, and finally the retainer means is released thereby resulting in the overhand knot.

10 Claims, 16 Drawing Figures

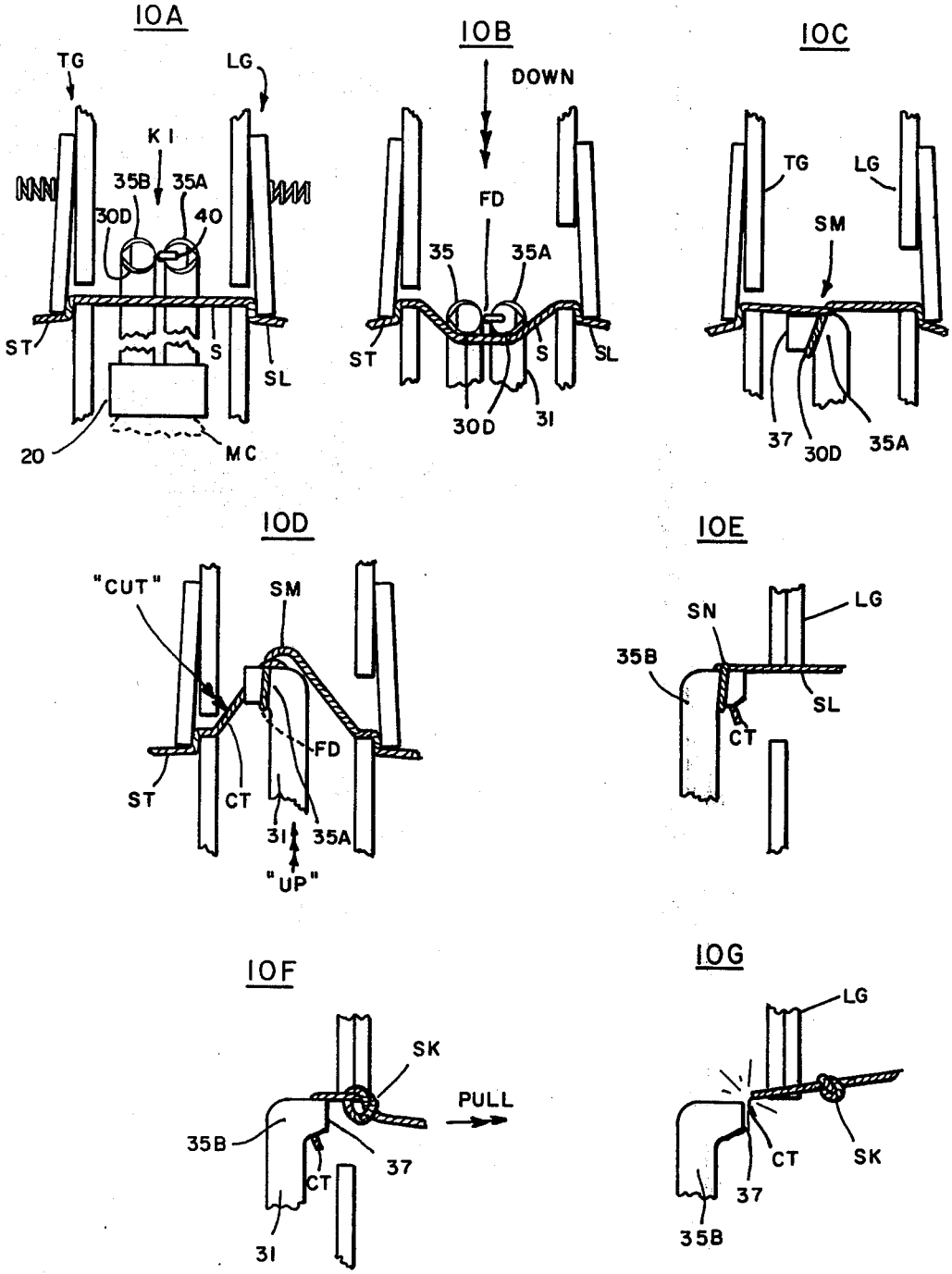
10A
TG
LG
K I
35B
35A
30D
40
ST
S
SL
20
MC
10B
DOWN
FD
35
35A
ST
S
SL
30D
31
10C
TG
LG
SM
37
30D
35A
10D
"CUT"
SM
FD
ST
CT
31
35A
"UP"
10E
LG
SN
35B
SL
CT
10F
SK
PULL
35B
37
CT
31
10G
LG
CT
SK
37
35B

KNOT TYING DEVICE AND METHOD FOR TYING

Knot tying devices comprising two or more bills or blades and which are adaptable for tying overhand knots from string or other flexible line are well known in the prior art. Relatively recent prior art is typified by U.S. Pat. Nos. 3,889,990 (Messa—June 17, 1975) and 3,112,132 (Fauring—Nov. 26, 1963).

Knot tying devices of the prior art, which utilize bills or blades, have generally suffered from the defect that for every distinct variation in thickness or quality of the flexible line e.g. string, substantial structural and/or dimensional changes must be made for the bills or other structural components of the knotting device, in order to attain the necessary degree of holding-fast retention of the string. For example, if the string is retained too looselely, the result will be too loosely tied knots which will have to be tied again. If on the other hand the string increment trail-end is retained too tightly during the knot tying process, the tension required to extricate the string is apt to exceed the string's tensile strength and it would be torn.

It is accordingly the general objective of the present invention to provide a knotting device of the bills or blades type which can expeditiously tie string or flexible lines into overhand knots. It is an ancillary general objective to provide a structurally simple and improved knotting device and of such versatile performance and reliability that a single structural and dimensional embodiment thereof will operably accommodate unusually wide ranges of string thickness and/or quality. It is a related general objective to provide novel method steps for tying string or other flexible line into overhand knots.

With the above and other objects and advantages in view, which will become more apparent as this description proceeds, the knot tying device and method concepts of the present invention generally comprise: a lower shank portion extending along an upright-axis, the shank being motivatable either manually or through conventional mechanized environment; a pair of sturdy angular bills each including a laterally restrained stalk extending uprightly from the shank and a laterally extending horn, each horn having a fore-end and a laterally extending inward-side thereby defining between the horns a transverse fixed-space; retainer means for yieldably securing the string increment trailward-length at a fissure-like discontinuity located between the horns; and the afore-recited structural elements being cooperatable to provide one mode for performing a novel method of making an overhand knot from a length of string or other analagous flexible line material;

In the drawing, wherein like characters refer to like parts in the several views, and in which;

FIG. 10, each provided with sequential alphabetical suffix, are elevational views sequentially schematically showing the knotting method steps of the present invention.

Figure 1:
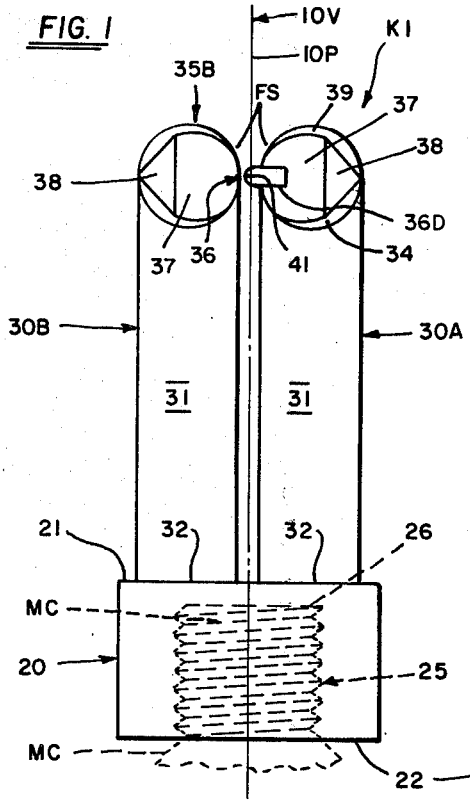
FIG. 1 is a forward elevational view of a first embodiment of the knotting device concept of the present invention.
Figure 3:
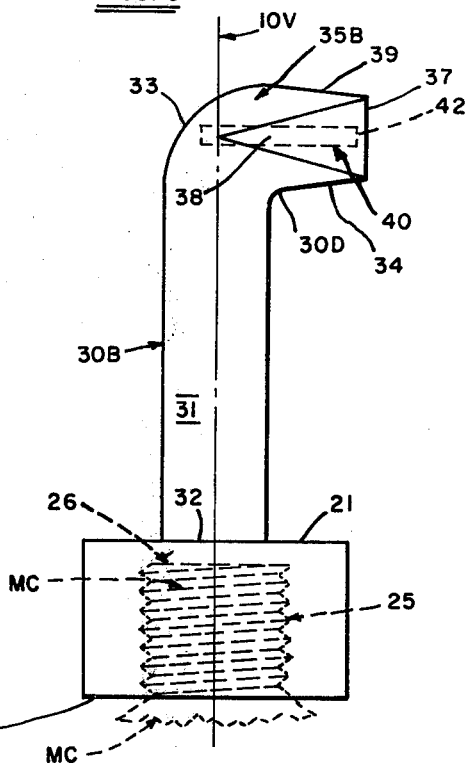
FIG. 3 is a right side elevational view of the first and of a second embodiment of the knotting device concept of the present invention.
Figure 4:
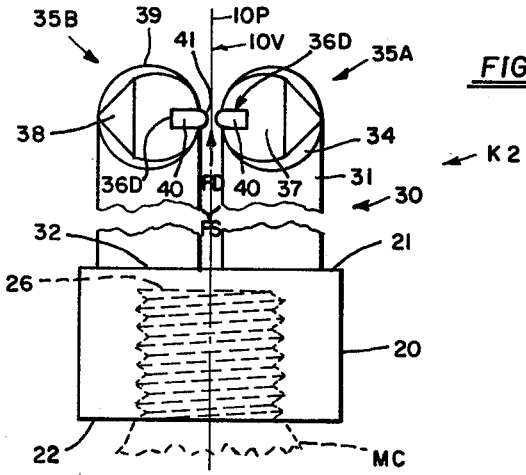
FIG. 4 is a forward elevational view of the second embodiment of the knotting device concept of the present invention.
Figure 5:
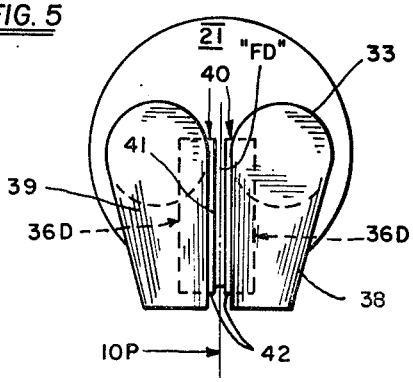
FIG. 5 is a top plan view of the FIGS. 4 and 3 second embodiment.
Figure 2:
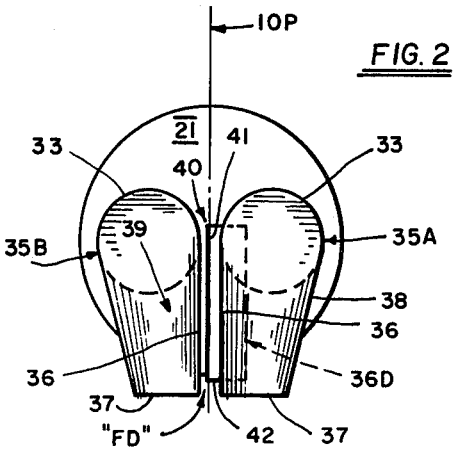
FIG. 2 is a top plan view of the FIG. 1 first embodiment.

Drawing FIGS. 1–9 depict three representative embodiments of the knotting device concept "K" of the present invention. Specifically, FIGS. 1–3 depict embodiment "K1," FIGS. 3–5 depict embodiment "K2", and FIGS. 6–9 depict embodiment "K3."

Turning initially to FIGS. 1–3 in this and in the next two paragraphs, embodiment "K1" will be treated; however, that which is stated in this and in the next paragraph also applies to embodiments "K2" and "K3." There is a lower shank portion 20 extending along an upright-axis "10V," herein as a cylindrical shank 20 circularly surrounding axis 10V and including planar top-side 21 and planar bottom-side 22 each transversely perpendicularly intersecting axis 10V. The shank at bottom-side 22 is provided with suitable connector means e.g. 25, for a motion control means "MC" portion of a conventional knotting mechanism environment (not shown). A typical connector means comprises a threaded bore 25 for shank 20 extending upwardly along axis 10V and terminating as a depth-end 26 located in elevation below top-side 21, the motion control "MC" being schematically shown as threadedly engaged with bore 25. "10P" indicates an imaginary laterally extending and upright plane, which plane "10P" passes through axis 10V and through or parallel to discontinuity "FD."

There is a pair of sturdy opposed angular bills 30A and 30B each including an upright stalk 31 extending rigidly uprightly of shank 20 and a laterally extending horn 35. Specifically, the knotting devices "K" comprise a pair of transversely spaced-apart horns 35A and 35B located on opposite sides of imaginary plane 10P, there being means to maintain an inviolable transverse fixed-space "FS" between the laterally extending inward-side 36 of the respective horns 35. For example, as depicted for embodiments "K1," "K2," and "K3," such fixed-spaced maintenance means might comprise manufacturing the entire angular bill 30 of rigid metallic structural material and welding the bottom-end 32 of the respective and herein parallel upright stalks 31 to the shank top-end 21. Accordingly, bills 30A and 30B are not movable in the lateral direction i.e. the stalks 31 and the horns 35 are laterally restrained. Each horn 35 includes a fore-end 37 whereby the two fore-ends 37 are in substantial transverse alignment, a laterally extending outward-side 38, a laterally extending roof-side 39, and a laterally extending underside 34. The two horns' undersides 34 are in substantial transverse alignment and especially at their crook-like angular merger 30D with the bill upright stalk 31. Each horn outward-side 38, which is preferably planar, converges inwardly from the stalk upper-end 33 to the horn fore-end 37 to facilitate directionally forward withdrawal of the noosed string from the horns 35. There are retainer means e.g.

40, 45, for yieldably securing the trailward-length of the string increment to be tied by knotting device "K." In a related vein, each horn 35 at roof-side 39 and especially at inward-side 36 is downwardly convergent toward a laterally extending fissure-like discontinuity at a said retainer means. Though the fissure-like discontinuity "FD" might be a tiny transverse gap or crevice, this term "fissure-like discontinuity" includes the situation wherein there is actual physical touching between the free-edge of the retainer (40, 41, 48, etc.) and its cooperating neighboring element (e.g. 41, 36).

For knotting device embodiment "K1" of FIGS. 1–3, the fissure-like discontinuity "FD" is a tiny transverse gap or crevice between the inward-side 36 of second-bill secondary-horn 35B and the laterally extending free-edge (41) of a clip-like retainer member. The retainer member 40 is in the form of a laterally extending web of resiliently compressible structural material e.g. rubber, partially embedded and attached e.g. adhesive, within a laterally extending slot 36D at the inward-side 36 of the first-bill primary-horn 35A. The clip-like retainer web 40 has its laterally extending free-edge 41 generally parallel to the inward-side 36 of secondary-horn 35B thereby providing a tiny transverse discontinuity "FD". The discontinuity "FD" is slightly dimensionally smaller than the diameter of the string selected for knotting. Herein, the retainer head-end 42 is shown within slot 36D slightly rearwardly recessed of horn fore-end 37.

For knotting device embodiment "K2" of FIGS. 3–5, the laterally extending and transverse-fissure discontinuity "FD" is a tiny transverse gap between the laterally extending lineal free-edges 41 of a pair of said retainer webs 40. In fact, embodiment "K2" differs from embodiment "K1" primarily in that there is the provision for another lateral slot 36D at the secondary-horn 35B at its inward-side 36 for mounting the additional resiliently compressible web-like strip 40.

Figure 6:
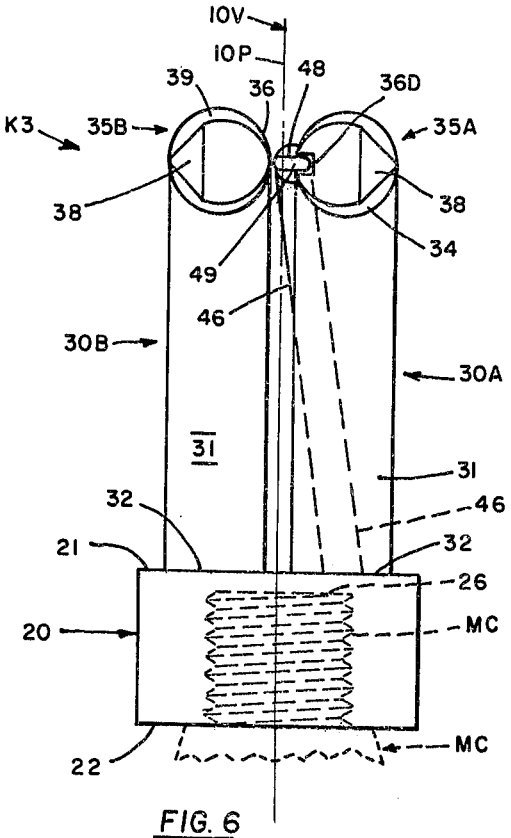
FIG. 6 is a forward elevational view of a third embodiment of the knotting device concept of the present invention.
Figure 8:
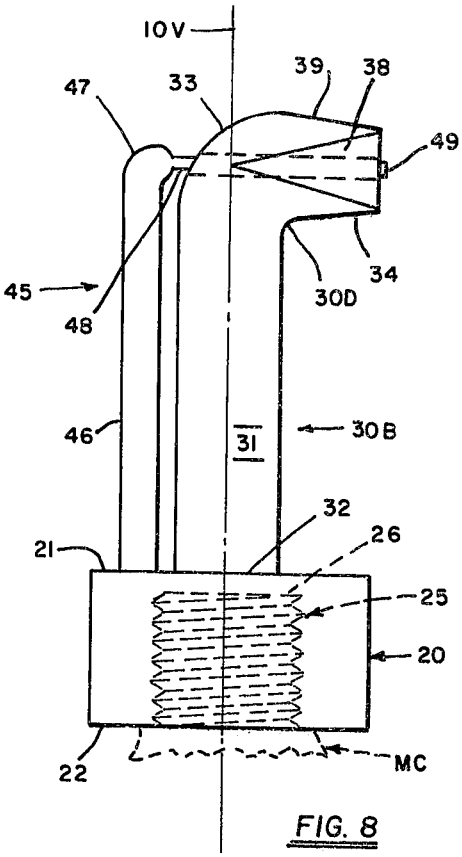
FIG. 8 is a right side elevational view of the third embodiment.
Figure 7:
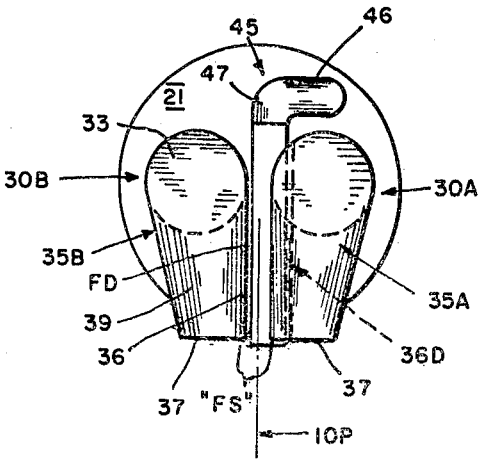
FIG. 7 is a top plan view of the FIG. 6 third embodiment.
Figure 9:
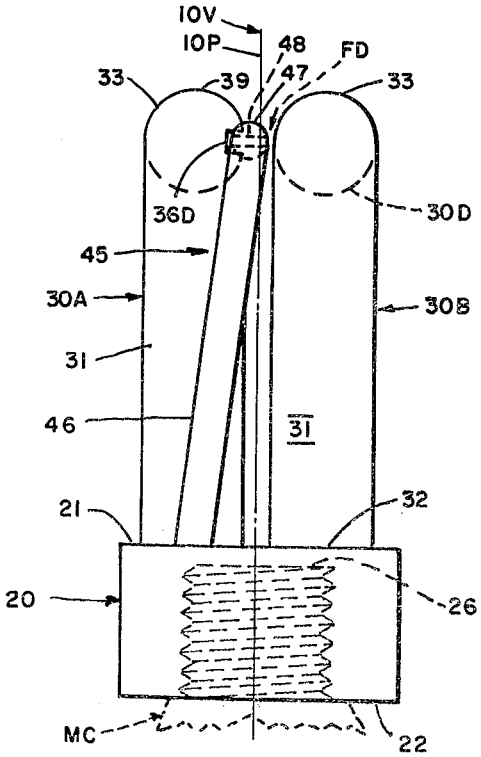
FIG. 9 is a rearward elevational view of the third embodiment of the knotting device concept of the present invention.

In the knotting device embodiment "K3" of FIGS. 6–9, the clip-like retainer means e.g. 45, is not of resiliently compressible structural material as are webs 40, but rather is of metallic structural material though of such length and strategic mounting as to function as a springy tongue 45. In fact, the fissure-like discontinuity "FD" is a tiny transverse gap between the inward-side 36 of second-bill secondary-horn 35B and the laterally extending fore-length 48 of springy metallic tongue 45. The entire tongue member 45 might be formed of a single length of springy metallic circular rod stock made by virtue of an angular intermediate bend 47 into generally L-shape and then rigidly though resiliently integrated into the knotting device "K" e.g. "K3". For example, the generally upright leg or stem 46 is rigidly attached, as by welding, to the shank top-side 21. The second and laterally extending leg 48 of tongue member 45 is located within the horns' fixed-spacing "FS" to provide the said laterally extending and transvrsely yieldable discontinuity "FD" at secondary-horn inward-side 36. As best seen in FIGS. 6 and 7, the springy tongue fore-length 48 might be altered from circular into rectangular cross-sectional shape, a portion of its transverse width extending into slot 36D though not affirmatively attached to said primary-horn 35A. Herein, the tongue head-end 49 is shown protruding slightly ahead of horn fore-end 37.

Novel method steps for providing an overhand knot "SK" from an incremental length "S" of string or other analagous lines, utilizing the knotting device concepts "K" of the present invention, will now be described, reference being had to the sequential steps depicted in FIGS. 10A–10G. Though in FIGS. 10A–10G the knotting device embodiment "K1" is shown, the same method steps can be employed with equivalent embodiments "K2," K3," etc. Moreover, the knotting devices "K" and the line length "S" can be manually manipulated without reliance upon mechanical control "MC" nor upon gates "LG" and "TG". Also, several string increments "S" might be simultaneously knotted on the same dual-horns knotting device.

The first method step, depicted in FIG. 10A, involves feeding the string incremental length "S" rightwardly from trail-gate "TG" underneath bill horns 35A and 35B to lead-gate "LG". Thus, the string length "S" has its trailward-length "ST" resiliently secured at gate "TG" and its leadward-length "SL" resiliently secured at gate "LG." Next, as depicted in FIG. 10B, the shank 20 and the bills 30 are moved downwardly along axis 10V (as indicated in triple-headed ¢DOWN" arrow) whereby the horns' undersides 34 near crooks 30D force the string length "S" to assume a U-shaped draping configuration. Next, as indicated in FIG. 10C, the shank 20 and the bill stalks 31 are turned some 270° about vertical-axis 10V whereby the string increment "S" has become a loop "SM" around horns 35A and 35B, the loop twist being located adjacent the horns' roof-sides 39. Moreover, the string trailward-length "ST" overlies fixed-spacing "FS" and substantially parallel the laterally extending imaginary plane "10P."

A crucial method step, depicted in FIG. 10D, entails moving the shank 20 and the bills 30 upwardly as indicated in triple-headed "UP" arrow. During this upward movement of bills 30 and horns 35, the string trailward-length "ST" is convergently directed by the horns' roof-sides 39 and inward-sides 36 and downwardly thrust into the laterally extending discontinuity "FD" and yieldably secured therein by the retainer means e.g. 40, 48, etc. Thus, the trailward-length is secured within the transverse-space "FS" but extending downwardly from the retainer means until below the horns' undersides 34 where the string is mechanically severed, this "CUT" providing for the string length a trail-end "CT." At the conclusion of step 10D, the string loop "SM" has become a noose "SN" by virtue of the string being yieldably secured at the fissure-like discontinuity "FD."

FIGS. 10E-10G indicate in step-wise fashion that when the string lead-end "SL" is steadily pulled away from the horns' free-ends 37, the noose "SN" slips laterally forwardly off the horns though the string trailward part "CT" is still appropriately retained at "FD." As indicated in FIG. 10F, with double-headed "PULL" arrow, the shank 20 and stalks 31 had been turned about axis 10V whereby the horns' lead-ends 37 desireably face the lead-gate "LG". Though the bills 30 and the horns 35 are both laterally and transversely fixed, the noose "SN" will slip off the horns 35 because of its convergent shape toward fore-ends 37 especially in view of forwardly-inwardly convergent outward-sides 38. The string trail-end "CT" continues to be retained at "FD" while the string lead-end "SL" and gradually-tightening knot "SK" continue moving away from horns 37. However, as graphically portrayed in FIG. 10G, by the time the overhand knot "SK" has become quite tight, coincidentally the forwardly moving string part "CT" appropriately yieldably disengages from its retainer "FD."

From the foregoing, the construction and operation of the knotting device and method will be readily understood and further explanation is believed to be unnecessary. However, since numerous modifications and changes will readily occur to those skilled in the art, it is not desired to limit the invention to the exact constructions an modes shown and described, and accordingly, all suitable modifications and equivalents may be resorted to, falling within the scope of the appended claims.

We claim:

1. A knotting device to tie string or other analagous flexible line, which string is fed incrementally to the knotting device commencing at the lead-end of a string-supply, into an overhand knot and said knotting device comprising:

A. a lower shank portion extending along an upright-axis, said shank having a top-side and also a bottom-side provided with connector means for motion control means of the knotting mechanism environment;

B. a pair of sturdy opposed angular bills each including a stalk extending uprightly from the shank top-side and a laterally extending horn whereby the knotting device comprises a pair of transversely spaced-apart horns including a primary-horn and a secondary-horn located on opposite sides of a laterally extending and upright imaginary-plane passing through said upright-axis, each horn having a fore-end and a laterally extending inward-side thereby defining between the horns a transverse fixed-space, each horn also having an outward-surface; and C. string retainer means for yieldably securing the string at a fissure-like discontinuity located between the horns, at least a portion of the said retainer means being resiliently yieldable toward the primary-horn when the trailward-length of the string increment to be knotted is thrust downwardly between the horns and thence downwardly into the said fissure-like laterally extending discontinuity.

2. The knotting device of claim 1 wherein the laterally extending fissure-like discontinuity exists between the secondary-horn inward-side and a laterally extending free-edge of a single clip-like retainer member.

3. The knotting device of claim 2 wherein the bills include a first-bill carrying the primary-horn and a second-bill carrying the secondary-horn, the bills stalks extending rigidly uprightly from the shank top-side whereby the transverse spacing between the horns inward-sides remains as a substantially constant fixed-space value; and wherein the bills at the inward-sides are downwardly convergent toward said fissure-like discontinuity.

4. The knotting device of claim 3 wherein the horns' outward-surfaces converge directionally forwardly toward the fore-ends thereby faciliating the string loups to ultimately slip forwardly off the horns.

5. The knotting device of claim 2 wherein the clip-like retainer member comprises a web of resiliently compressible structural material attached to the first-bill and extending along the primary-horn inward-side, the retainer web also extending transversely from the primary-horn with its laterally extending free-edge being alongside the secondary-horn inward-side.

6. The knotting device of claim 2 wherein the primary-horn is provided with a laterally extending recess along its inward-side; and wherein the clip-like retainer member comprises a resiliently yieldably springy tongue located within the primary-horn recess and extending transversely therefrom alongside the secondary-horn inward-side and there providing the fissure-like discontinuity for grasping the string.

7. The knotting device of claim 6 wherein the springy tongue is metallic and of inverted L-shaped configuration with the upright stem thereof being substantially parallel to a bill stalk and being rigidly integrated into the knotting device.

8. The knotting device of claim 7 wherein the transverse spacing between the horns inward-sides remians as a substantially constant fixed-value; and wherein the bills horns at the inward-sides are downwardly convergent toward said fissure-like discontinuity.

9. The knotting device of claim 8 wherein the stem of the L-shaped springy metallic tongue is rigidly attached to the shank top-side, as by welding.

10. The method for making an overhand knot from string or other analagous flexible line, which is fed incrementally to a knotting device commencing at the lead-end of a string-supply, said knotting device generally comprising a pair of sturdy angular bills extending uprightly from a movably controllable shank and the bills including laterally extending opposed horns, the knotting device also including transversely yieldable string retainer means located between the horns inward-sides, said method comprising the following steps in order:

A. feeding the string increment from the string-supply beneath the bills' angular crooks, and securing the string lead-end to an anchoring means;

B. moving the bills downwardly below the elevation of the anchoring means whereby the string increment assumes a U-shaped configuration under downward tension from the bills lateral horns;

C. turning the bills more than 180° whereby the string progresses from said U-shape to a loop around the horns and including a string twist thereabove whereby the trailward-length of the string increment extends directionally laterally and overlies the fixed-space between the horns;

D. moving the knotter bills upwardly whereby the string trailwardly-length is downwardly thrust between the horns and is yieldably secured at the retainer means, the loop thus becoming a noose;

E. severing the string trailmost portion which depends from the retainer means;

F. turning the bills about an upright-axis parallel thereto whereby the bill horns fore-ends face the string lead-end anchoring means;

G. pulling the string lead-end away from the horns fore-ends and the string retained portion whereby there sequentially occurs; the noose slips laterally forwardly off the horns; and next the string trailward portion is yieldably released by the retainer means.

* * * * *